United States Patent [19]

Haitmanek

[11] 3,989,339

[45] Nov. 2, 1976

[54] ELECTRICAL CONNECTOR AND METHOD OF MAKING SAME

[75] Inventor: Louis F. Haitmanek, Florham Park, N.J.

[73] Assignee: Thomas & Betts Corporation, Elizabeth, N.J.

[22] Filed: Oct. 2, 1975

[21] Appl. No.: 618,913

[52] U.S. Cl. ..... 339/97 C

[51] Int. Cl.[2] ..... H01R 11/20

[58] Field of Search ..... 339/97–99, 339/276

[56] References Cited

UNITED STATES PATENTS 3,736,627 6/1973 Sosinski ..... 339/98

3,814,836 6/1974 Neale, Sr. ..... 339/97 C

*Primary Examiner*—Joseph H. McGlynn

*Attorney, Agent, or Firm*—David Teschner; Jesse Woldman

[57] ABSTRACT

A plurality of conductor grasping and piercing ridges are selectively disposed at an oblique angle to the longitudinal axis of a metallic crimpable ferrule and extend outwardly from its interior wire receiving surface so that upon crimping the ferrule about a wire inserted therewithin, the ridges penetrate the periphery of the wire along an obliquely oriented path defining a number of incrementally displaced transverse planes longitudinally offset from one another to avoid shearing or severing the wire along any one common transverse plane.

13 Claims, 12 Drawing Figures

ELECTRICAL CONNECTOR AND METHOD OF MAKING SAME

BACKGROUND OF THE INVENTION

1. Field of the Invention

The invention is directed to the field of crimpable electrical connectors having conductor grasping means in the ferrule portion thereof.

2. Description of the Prior Art

Electrical connectors having interiorly ridged or toothed crimpable ferrule portions are well known in the art and are variously employed to provide a connection to either insulated or uninsulated conductors inserted within the ferrule portion. The ridges or teeth are selectively contoured to penetrate the outer periphery or surrounding insulation of the conductor and engage the interior conductive portion thereof to provide increased electrical and mechanical engagement between the connector and the conductor. Examples of such prior art devices are generally described in U.S. Pat. No. 2,800,638 issued to Hammell; U.S. Pat. No. 3,355,698 issued to Keller; U.S. Pat. No. 3,736,627 issued to Sosinski and assigned to the assignee of the instant invention; and U.S. Pat. No. 3,812,448 issued to Haitmanek and assigned to the assignee of the instant invention. The disposition of the conductor engaging ridges in an orientation substantially transverse to the longitudinal axis of the connector results in a penetration of the conductor in a series of transverse planes. Since the ridge heights are often designed to penetrate the conductor to a substantial depth relative to the diameter of the conductor as the ferrule is crimped thereabout, the conductor may thus be readily sheared or fractured along one or more transverse planes each defined by coincident portions of an associated ridge, thereby seriously damaging or in some case completely destroying the integrity of the electrical connection or joint. The herringbone pattern of ridges disclosed in the above mentioned Sosinski patent fails to avoid this problem since the alternating arrangement of obliquely angled ridge segments almost insures that at least two segments of a particular ridge will be in substantial coincidence with one another along a single transverse plane as the ferrule is crimped about the conductor, thereby effecting the shearing or fracturing condition noted above. Although the use of ridged ferrules to provide an elongate piercing or penetrating edge for improved electrical and mechanical connections is highly desirable, there is an increasing need for a ridged connector construction which will avoid the undesirable characteristics noted above.

SUMMARY OF THE INVENTION

The invention overcomes the limitations and difficulties noted above with respect to prior art devices by providing an electrical connector having a crimpable ferrule member which is more reliable and efficient than such prior art devices. The crimpable ferrule member comprises an interior wire receiving surface on which is disposed a plurality of elongate preferably sharply crested ridges for piercingly engaging a conductor inserted within the ferrule. The ridges each extend along a single axis which is oriented at an oblique angle to the longitudinal axis of the ferrule and each may comprise either a single uninterrupted ridge or a series of segments selectively located to provide a longitudinally extending non-ridged zone arranged to define a folding line for the ferrule. The ferrule member may be conveniently constructed from flat stock blanked and ridged to the desired dimensions and then folded or formed into the desired configurations such as a cylinder or U-shape. The ferrule may thereafter be crimped or otherwise compressed into the final shape such as a square, rectangle, or any other convenient polygonal configuration. The ridges thus pierce and engage an enclosed conductor along an obliquely oriented longitudinally displaced path which avoids coincident penetration of the conductor by portions of the ridges along any one common shearing plane. It is thus an object of this invention to provide an improved electrical connector.

It is a further object of this invention to provide a ferrule construction which permits deep penetration of an enclosed conductor while advantageously avoiding shearing or fracturing the conductor.

It is another object of this invention to provide a method for manufacturing a selectively ridged electrical ferrule.

It is still a further object of this invention to provide a crimpable ferrule construction which avoids loss of electrical contact between the ferrule and an enclosed conductor in use.

It is yet another object of this invention to provide an interiorly ridged ferrule construction in which the conductor engaging ridges are selectively oriented to avoid shearing or fracturing the enclosed conductor.

Other objects and features will be pointed out in the following description and claims and illustrated in the accompanying drawings which disclose, by way of example, the principle of the invention and the best modes contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 1:
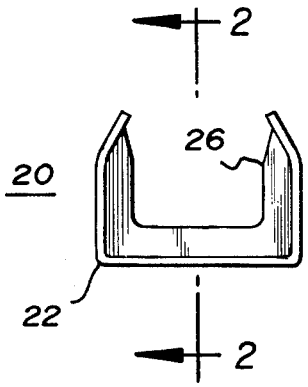
PRIOR ART FIG. 1
FIG. 1 is a front elevational view of a prior art electrical connector.
Figure 2:
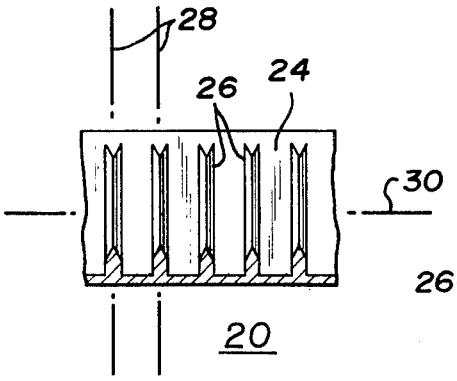
PRIOR ART FIG. 2
FIG. 2 is a fragmentary side elevational view, partly in section, of the prior art device of FIG. 1 taken along the lines 2—2.
Figure 3:
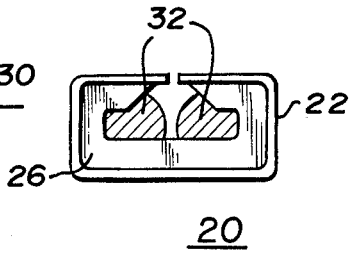
PRIOR ART FIG. 3
FIG. 3 is a front elevational view of the prior art device of FIG. 1 showing the connector crimped about a pair of conductors.

Turning now to FIGS. 1, 2, and 3 there is shown a prior art connector 20 comprising a ferrule member 22 having disposed on its interior surface 24 a plurality of conductor engaging ridges 26 all extending along respective axes 28 (FIG. 2) which are oriented generally perpendicular to the longitudinal axis 30 of the ferrule member 22. As the connector 20 is crimped about one or more conductors 32 (FIG. 3) to provide an electrical connection therebeween, the ridges 26 pierce the conductors 32 along respective transverse planes perpendicular to the longitudinal axes of the conductors 32. Since all portions of each ridge 26 are in coincidence with one another as the connector 20 is crimped radially inwardly against the conductors 32, each conductor is penetrated to the full depth of the adjacent ridge portion along a multiplicity of common transverse planes. Thus, if the height of the ridge 26 is approximately equal to the radius of the conductor 32, the conductor 32 will be substantially sheared through or fractured at the location of each ridge 26, thereby severely diminishing or in many cases totally destroying both the mechanical and electrical integrity of the connection. It is thus seen that the conductor 32 will be subjected to a total penetration, along any one common plane, at least equal to twice the height of the ridge 26.

Figure 4:
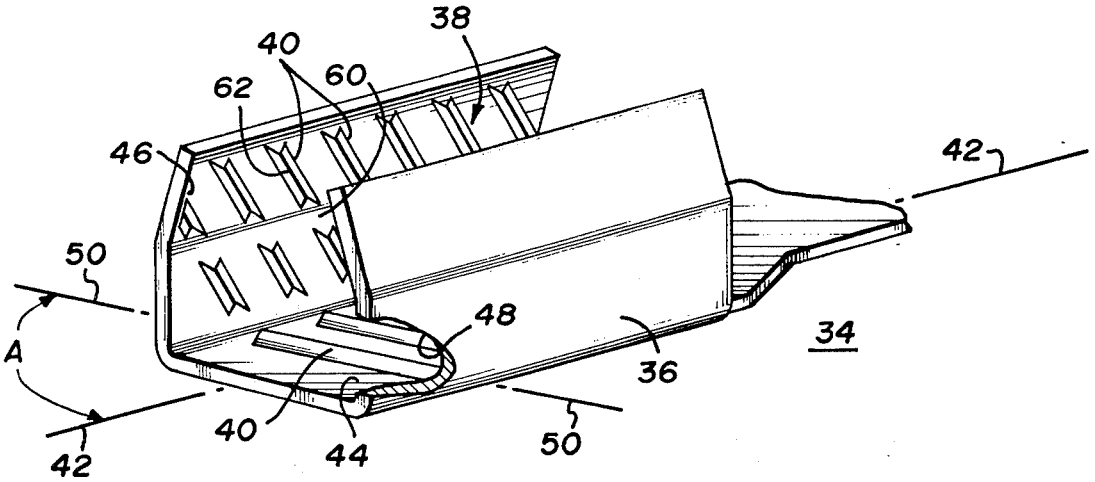
FIG. 4 is a fragmentary perspective view, partly cut away and partly in section, of an electrical connector constructed in accordance with the concepts of the invention.
Figure 5:
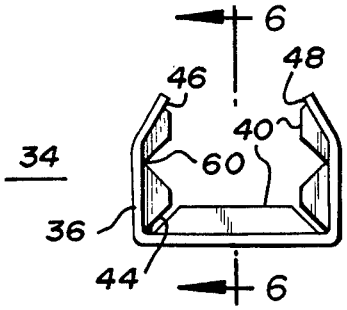
FIG. 5 is a front elevational view of the device of FIG. 4.
Figure 6:
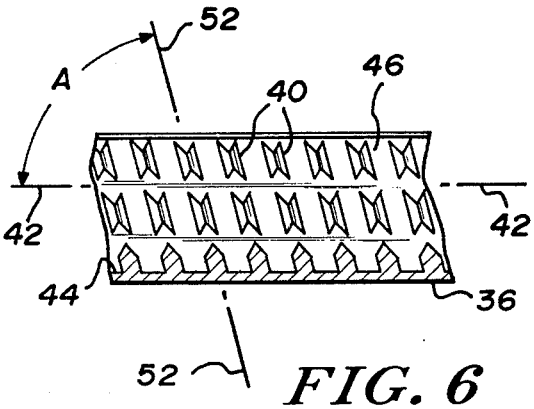
FIG. 6 is a fragmentary side elevational view, partly in section, taken along the line 6—6 of FIG. 5.
Figure 8:
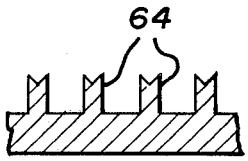
FIG. 8 is a fragmentary sectional view of a further embodiment of the ridges of a connector constructed in accordance with the concepts of the invention.
Figure 9:
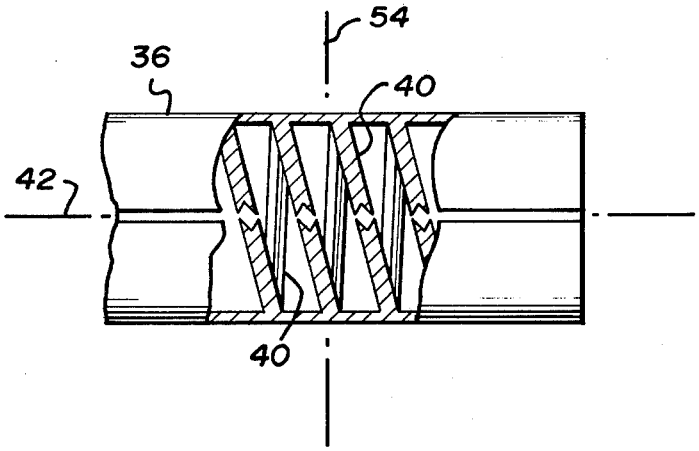
FIG. 9 is a fragmentary top plan view, partly cut away and partly in section, of the device of FIG. 4 showing the disposition of the ridges after a crimping operation.
Figure 10:
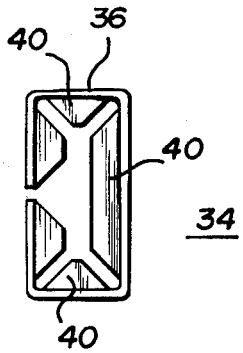
FIG. 10 is a side elevational view of the crimped arrangement shown in FIG. 9.
Figure 11:
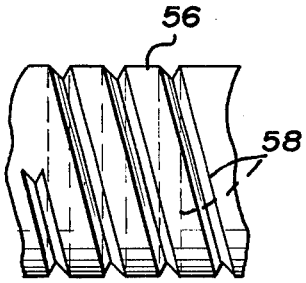
FIG. 11 is a fragmentary view of a portion of a conductor showing the depressions made after crimping by an embodiment of a ridged connector constructed in accordance with the concepts of the invention.
Figure 12:
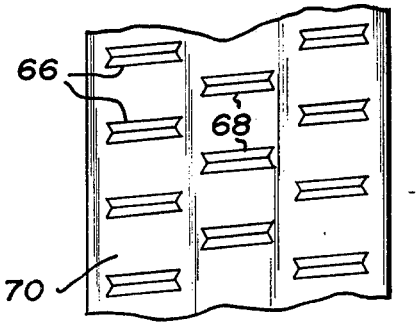
FIG. 12 is a fragmentary top plan view of a further embodiment of a blanked segment for forming a ridged ferrule member in accordance with the concepts of the invention.

Turning now to FIGS. 4, 5, 6, 9, 10, and 11 there is shown a connector 34 constructed in accordance with the concepts of the invention and designed to avoid the above condition. The connector 34 comprises a metallic ferrule member 36 shown, for the sake of convenience, as substantially U-shaped, and is constructed preferably of a readily deformable metallic material having low electrical resistance, such materials including copper, brass, phospher bronze, beryllium copper, aluminum, and other alloys well known in the art. The ferrule member 36 comprises a wire receiving interior surface 38 on which is disposed a plurality of elongate teeth or ridges 40, each shown as selectively divided into segments, but each of which may be alternatively formed as contiguous elements extending outwardly from the interior surface 38. Each of the segments of each ridge 40 is so disposed on its respective portion of the interior surface 38 of the ferrule member 36 as to be axially oriented at an oblique angle with respect to the longitudinal axis 42 (FIG. 4) of the ferrule member 36. For the sake of explanation, reference is specifically made to FIG. 4 wherein the ferrule member 36 is shown as comprising three readily definable interior surface portions including a base surface 44, a first interior upstanding surface portion 46, and a second interior upstanding surface portion 48. The segments of the teeth or ridges 40 disposed on the base surface 44 along respective axes such as 50 are oriented at an included angle A with respect to the longitudinal axis 42, angle A being somewhat less than 90° and preferably in the range of between 5° and 85°. A similar angular relationship exists with respect to the segments of the ridges 40 disposed on the first and second interior surface portions 46 and 48, respectively. For example, as shown specifically in FIG. 6, the segments of the ridges 40 disposed on the first interior upstanding surface 46 extend along respective axes 52 oriented at the included angle A with respect to the longitudinal axis 42 of the ferrule member 36. A similar relationship exists with respect to the relative axial orientation between the segments of the ridges 40 disposed on the surface 48 and the longitudinal axis 42. Thus, as the arms of the ferrule member 36 are crimped inwardly, as shown, for example, in FIGS. 9 and 10, the various segments of each ridge 40 are longitudinally displaced from one another along the axis 42 and obliquely oriented with respect to a transverse plane 54 (FIG. 9) passing through the ferrule member 36. A conductor such as 56 (FIG. 11) inserted within the ferrule member 36 is thus caused to be penetrated about its periphery along a non-coincident obliquely oriented path with respect to the longitudinal axis of the conductor 56, in a manner similar to that shown by the solid and dotted outlines 58 in FIG. 11. Thus the maximum penetration of the conductor 56 along any one plane extending across the conductor 56 either perpendicular to its longitudinal axis or at an oblique angle thereto is limited to the height of the ridge 40. Accordingly, the ridge height may be designed to penetrate the conductor to a depth substantially equal to the radius of the conductor 56, or one half the thickness thereof in the case of rectangular or square conductors, without danger of shearing or fracturing the conductor upon completion of the crimped connection. As further illustrated in FIGS. 4, 5, and 6, the ridges 40 are each divided into several selectively spaced segments in a predetermined pattern, the composite arrangement including a plurality of longitudinally extending rows each separated from an adjacent row by a longitudinally extending non-ridged zone or area, one such area being indicated by the numeral 60. The areas such as 60 may be conveniently employed to provide a prearranged folding pattern for the ferrule member 36. By way of example, the arrangement illustrated in FIG. 4 provides a series of folding lines located in such manner as to cause the ferrule member 36 to readily collapse or deform into a substantially rectangular configuration, in cross section, as shown in FIG. 10. It will, of course, be readily apparent to those skilled in the art that other folding patterns may be similarly employed to induce the ferrule member to collapse or fold in any one of a number of other necessary or desirable polygonal configurations. It should be further noted that each of the ridges 40, although shown as substantially triangular in cross section and terminating in a sharpened crest 62 (FIG. 4), may be alternatively configured to provide other necessary or desirable cross sectional contours. For example, a double crested arrangement such as indicated at 64 in FIG. 8 may be readily substituted for the single crested configuration shown in FIG. 4 without departing from the spirit of the invention and within the concepts herein disclosed. For the sake of convenience, the ridges 40 may be disposed in a uniform pattern over substantially the entire interior surface 38 of the ferrule member 36, with a uniform spacing between ridges. Alternatively, the ridges 40 may be selectively arranged in groups (not shown) having one spacing between the ridges of any one group and another spacing between each group. A further embodiment of a ridge pattern is shown in FIG. 12 wherein a plurality of first ridges 66 and a plurality of second ridges 68 are arranged in staggered disposition over a surface 70 adapted to define an interior wire receiving surface of a ferrule member to be formed therefrom. The embodiment illustrated in FIG. 12 may be advantageously employed where it is necessary or desirable to reduce the length of peripheral engagement of a conductor without reducing the degree of penetration or the longitudinal spacing between ridges.

Figure 7:
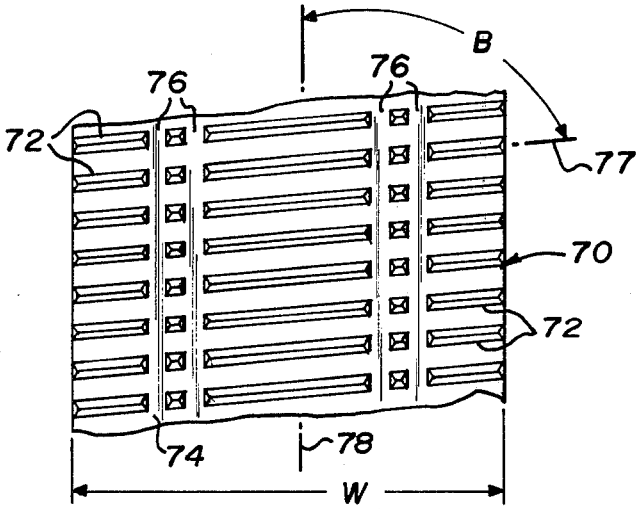
FIG. 7 is a fragmentary top plan view of a blanked segment for forming an electrical connector in accordance with the concepts of the invention.

Referring now to FIG. 7, a ferrule member such as 36 may be readily manufactured from a given length of flat metallic stock 70 having a predetermined width W. The stock 70 may be subjected to a suitable operation to provide a plurality of ridges 72 similar to ridges 40 on a first or upper surface 74 of the stock 70. The ridges 72 extend along respective axes such as 77 oriented at an oblique angle B with respect to the longitudinal axis 78 of the element 70. It will of course be appreciated that the angle B may vary between 5° and 85°, as indicated above with respect to the angle A shown in FIGS. 4 and 6. The element 70 is then subjected to a forming operation wherein the surface 74 comprises the interior of the ferrule member, the ridges 72 thereby being located over the interior surface of the ferrule member. In the embodiment illustrated in FIG. 7, the ridges 72 are each shown divided into discrete spaced segments similar to the arrangement shown in FIGS. 4, 5, and 6, although, in either case, the ridges 40 and 72 may be provided as unbroken contiguous elements, where necessary or desirable. Furthermore, the arrangement of ridges illustrated in FIG. 7, although specifically designed to provide folding zones 76 essentially duplicative of the zones 60 shown in FIG. 4 to encourage collapse or deformation of the ferrule member into an essentially rectangular configuration, may be modified in a suitable manner as indicated above to provide other crimped configurations well known to those in the art. The element 70 may be initially formed into a generally U-shaped ferrule member similar to member 36 wherein the zones 76 will serve to define the longitudinally extending edges of a rectangle as the ferrule member is crimped about a conductor in the manner illustrated in FIG. 10. Accordingly, the oblique disposition of each of the ridge segments of element 70 with respect to the longitudinal axis 78 of the ferrule member formed therefrom will be essentially as described above with respect to the embodiment illustrated in FIGS. 4, 5, and 6, and the corresponding path of conductor penetration will similarly be substantially as shown in FIG. 11.

The embodiments of the invention in which an exclusive property or privilege is claimed are defined as follows:

1. An electrical connector comprising: a crimpable metallic ferrule member having a wire receiving interior surface, a plurality of elongate ridges each extending outwardly from said interior surface and circumscribing substantially the entire inner periphery of said interior surface, each of said ridges lying along a longitudinal axis which extends parallel to a respective portion of said interior surface and which is oriented at a given oblique angle with respect to the longitudinal axis of said ferrule member for piercing engagement with a wire inserted therewithin, whereby upon crimping said ferrule member about such wire, each of said ridges is caused to penetrate the periphery of such wire and engage the interior thereof along an obliquely oriented path with respect to the longitudinal axis of such wire, so that such wire is penetrated about its periphery along incrementally displaced transverse planes longitudinally offset from one another to avoid shearing such wire along a common plane.

2. An electrical connector as defined in claim 1 wherein said longitudinal axes of said ridges are oriented at an included angle of between 5° to 85° with respect to the longitudinal axis of said ferrule member.

3. An electrical connector as defined in claim 1 wherein said ridges are aligned in substantially parallel relationship with respect to one another.

4. An electrical connector as defined in claim 3 wherein each of said ridges is selectively divided into spaced segments each having a given length, said ridge segments being disposed in longitudinally extending rows each separated from an adjacent row by a non-ridged area arranged to provide a folding line thereat for the ferrule member.

5. An electrical connector as defined in claim 4 wherein said ferrule member is substantially U-shaped.

6. An electrical connector as defined in claim 5 wherein said folding lines are arranged to define the corners of a rectangular configuration in cross section as said ferrule member is crimped about a wire inserted therewithin.

7. An electrical connector as defined in claim 6 wherein said longitudinal axes of said ridges are oriented at an included angle of between 5° to 85° with respect to the longitudinal axis of said ferrule member.

8. An electrical connector as defined in claim 1 wherein said ridges each terminate in a sharp crest to facilitate piercing through the outer periphery of a wire crimpably engaged within said ferrule member.

9. An electrical connector as defined in claim 8 wherein said ridges are arranged in a predetermined pattern over substantially the entire area encompassed by said interior surface.

10. An electrical connector as defined in claim 9 wherein said ridges are arranged in uniformly spaced disposition over said interior surface.

11. A method of making an electrical connection comprising the steps of: providing a crimpable metallic ferrule member having a wire receiving interior surface on which are disposed a plurality of parallel elongate ridges each extending outwardly from said interior surface and lying along a respective longitudinal axis which extends parallel to a respective portion of said interior surface and which is oriented at an oblique angle to the longitudinal axis of said ferrule member; inserting a given length of a conductor within said ferrule member; and selectively folding said ferrule member inwardly against said conductor to cause said ridges to penetrate the outer periphery of said conductor along a path defined by incrementally displaced transverse planes longitudinally offset from one another.

12. A method as defined in claim 11 wherein said ferrule member is folded to define a substantially rectangular configuration, in cross section.

13. A method as defined in claim 11 wherein said ferrule member is compressed uniformly inwardly over its entire length.

* * * * *